US005943730A

United States Patent [19]

Boomgaarden

[11] Patent Number: 5,943,730

[45] Date of Patent: Aug. 31, 1999

[54] SCRUBBER VAC-FAN SEAL

[75] Inventor: Steven L. Boomgaarden, Rosemount, Minn.

[73] Assignee: Tennant Company, Minneapolis, Minn.

[21] Appl. No.: 08/977,274

[22] Filed: Nov. 24, 1997

[51] Int. Cl.[6] ..... A47L 7/00

[52] U.S. Cl. ..... 15/320; 15/327.1; 277/602; 277/615; 277/626; 277/913

[58] Field of Search ..... 15/320, 300.1, 15/327.1, 321, 322, 327.7, 412, 353; 277/602, 608, 613, 615, 626, 644, 647, 913; 55/355

[56] References Cited

U.S. PATENT DOCUMENTS

| | | | |
|---|---|---|---|
| 4,348,783 | 9/1982 | Swanson et al. | 15/320 |
| 4,463,474 | 8/1984 | Jacobs . | |
| 4,557,739 | 12/1985 | Fortmann et al. | 55/320 |
| 4,650,504 | 3/1987 | Howeth . | |
| 4,723,337 | 2/1988 | Ellison et al. . | |
| 4,819,676 | 4/1989 | Blehert et al. . | |
| 4,964,189 | 10/1990 | Rau et al. | 15/353 |
| 4,998,740 | 3/1991 | Tellier | 277/205 |
| 5,093,955 | 3/1992 | Blehert et al. | 15/320 |
| 5,205,014 | 4/1993 | Yoo . | |
| 5,331,713 | 7/1994 | Tipton | 15/320 |
| 5,369,838 | 12/1994 | Wood et al. . | |
| 5,473,792 | 12/1995 | Kent et al. | 15/320 |
| 5,813,086 | 9/1998 | Ueon et al. | 15/320 |

*Primary Examiner*—Robert Warden
*Assistant Examiner*—Andrew Aldag
*Attorney, Agent, or Firm*—Dorn, McEachran, Jambor & Keating

[57] ABSTRACT

A surface maintenance machine has a body, wheels for supporting the body, a source of cleaning solution on the body and a conduit for applying the cleaning solution to a surface to be cleaned. There are scrub brushes on the body and there is a squeegee carried by the body. A container for used cleaning solution is located on the body and there is a vacuum system, including a vacuum fan, for removing used cleaning solution from adjacent the squeegee and conveying it to the used cleaning solution container. The vacuum system includes a conduit between the used cleaning solution container and the vacuum fan. There is a seal extending about this conduit, with the exterior of the seal being exposed to atmospheric pressure and the interior being exposed to the less than atmospheric pressure of the vacuum system. The seal has connected annular lip portions, with the pressure difference between opposite sides of the seal moving said lip portions into tight sealing contact with the conduit and adjacent portions of the vacuum system.

6 Claims, 2 Drawing Sheets

Fig. 1.
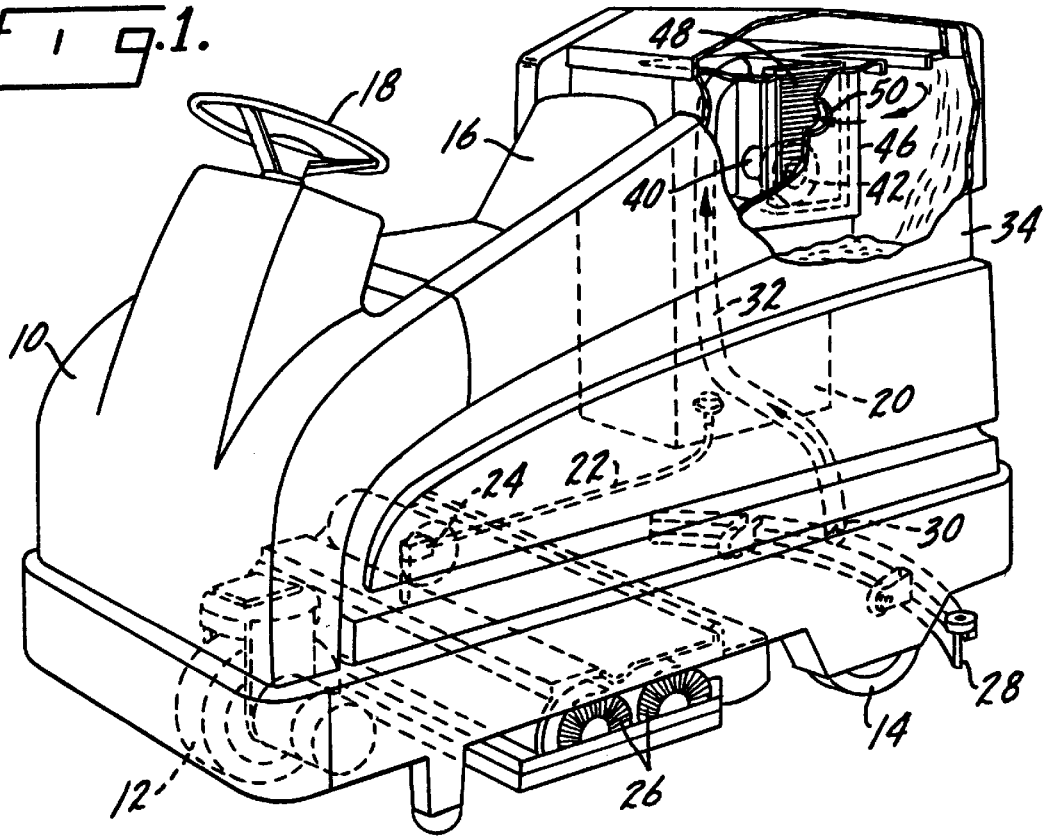
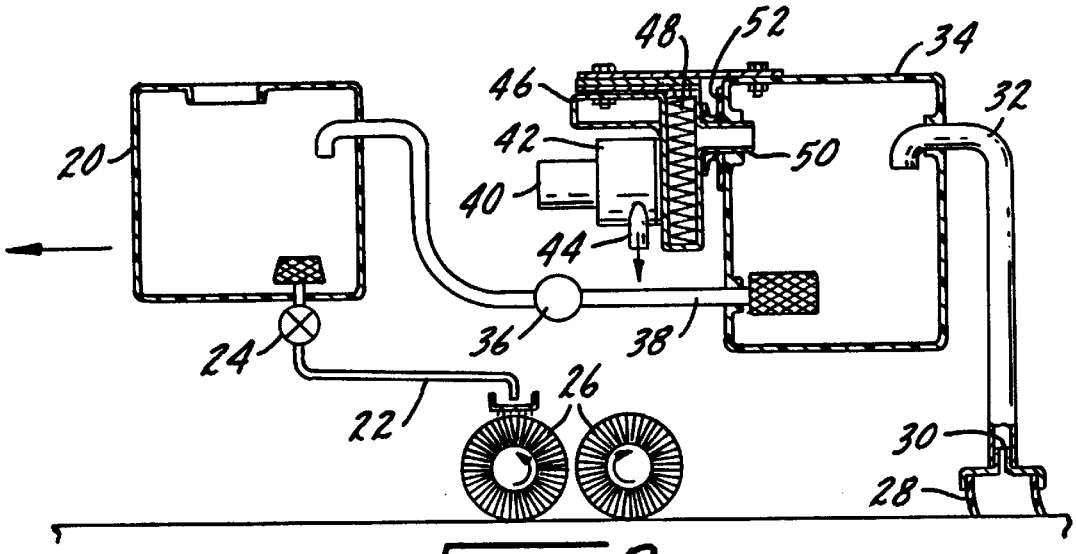
Fig. 2.

60
62
48
58
56
54
46
40
42
44
64
50
52
66
67
68
69
70
32
34

SCRUBBER VAC-FAN SEAL

THE FIELD OF THE INVENTION

The present invention relates to scrubbing machines of the type in which the operator may ride on the machine or they may be of the so-called walk-behind type. Such machines typically have a source of cleaning solution, brushes for agitating the soiled surface to be cleaned, and a squeegee which wipes up the used cleaning solution which is then conveyed by a vacuum system into a soiled cleaning solution container. It is important to prevent atmospheric air from leaking into the vacuumized suction air circuit, and particularly so at the location where the soiled solution recovery tank is coupled to what is termed the demister tank. The present invention provides an improved seal at this specific location, which seal has a pair of annular lips joined or linked at their inner diameters. There is a pressure difference across the seal. The outside is exposed to the subatmospheric pressure of the vacuum system. The outside air pressure presses on the lips of the seal and flexes or flattens them against the adjoining surfaces of the recovery tank and the demister tank. The more the vacuum, the tighter the seal. There is substantial sealing ability to compensate for irregularities in the adjoining surfaces or variation in spacing between them.

SUMMARY OF THE INVENTION

The present invention relates to scrubbing machines in which there is a vacuumized recovery system and in particular to an improved seal between the recovery tank and adjoining portions of the vacuum system.

A primary purpose of the invention is the use of a seal with multiple lips connecting the recovery tank and the demister tank of a scrubber of the type described.

Another purpose is a vacuum system for a scrubber as described in which the cross section of the seal between the recovery tank and the demister tank is somewhat V-shaped with lips which will seal against the tank surfaces due to the pressure difference across the seal.

Another purpose is a scrubber as described in which the seal between the recovery tank and the demister tank has the ability to conform to the contours of the adjoining surfaces to provide a complete seal against atmospheric air from leaking into the vacuum air system.

Other purposes will appear in the ensuing specification, drawings and claims.

BRIEF DESCRIPTION OF THE DRAWINGS

The invention is illustrated diagrammatically in the following drawings wherein:

FIG. 1 is a perspective of a scrubber of the type disclosed herein;

FIG. 2 is a diagrammatic illustration of the cleaning elements of the scrubbing system and the vacuumized fluid recovery;

DESCRIPTION OF THE PREFERRED EMBODIMENT

Figures 3, 4, 5, 6:
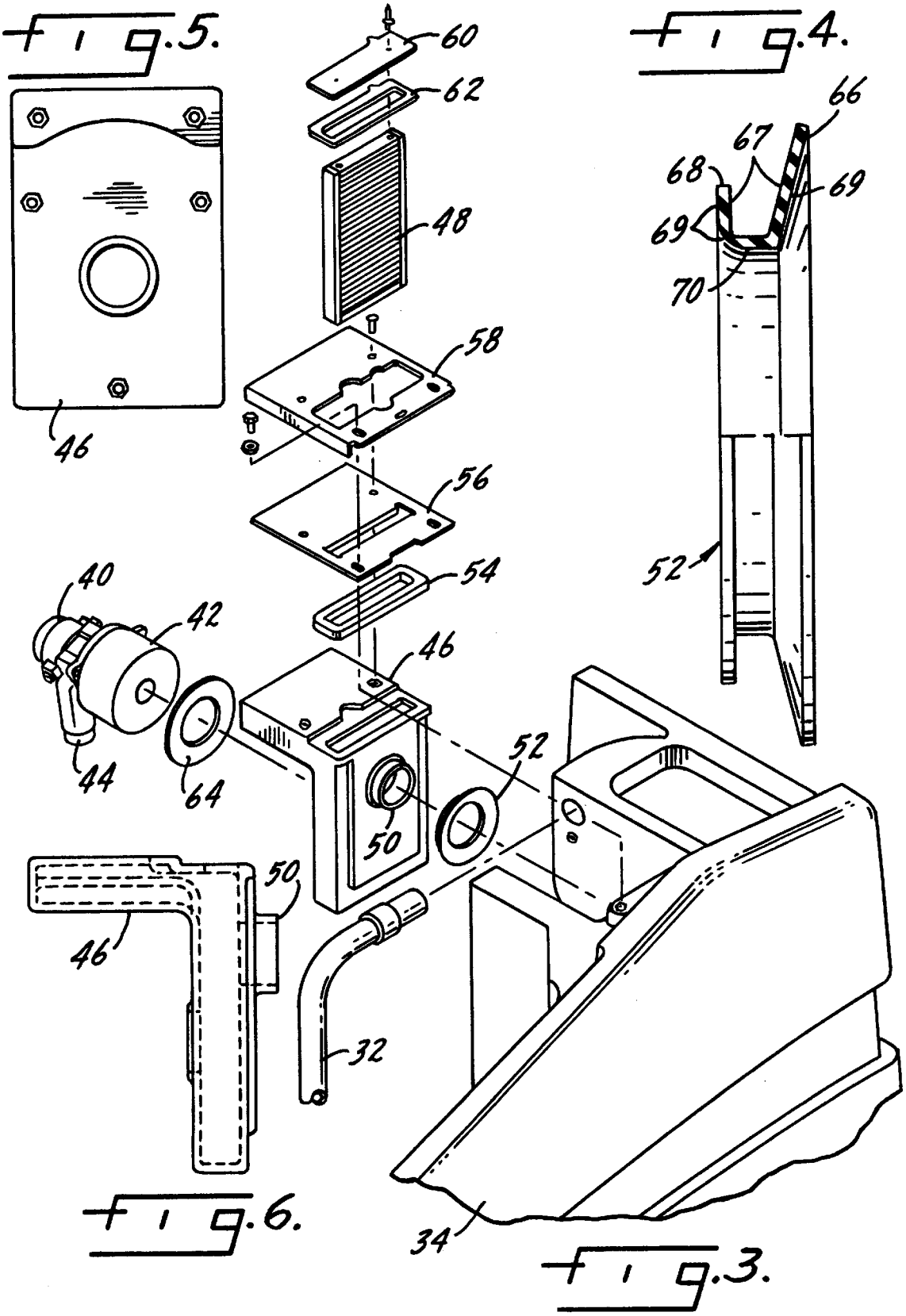
FIG. 3 is an exploded perspective illustrating the location of the seal disclosed herein.
FIG. 4 is a side view, in cross section, of the seal between the recovery tank and the demister tank.
FIG. 5 is a front view of the demister tank.
FIG. 6 is a side view of the demister tank.

In FIG. 1, the illustrated scrubber has a body 10 which is supported on a front wheel 12 and on rear wheels, one of which is shown at 14. There is an operator seat 16 and an adjacent steering wheel 18. As indicated above, the scrubber will have a clean solution tank, a recovery tank, brushes for cleaning the underlying surface and a vacuumized recovery system. All of these components are illustrated diagrammatically in FIG. 2.

The clean solution tank is indicated at 20 and has a conduit 22 controlled by a valve 24, which may be regulated by the operator, to supply a cleaning solution directly above the front brush of the two scrubbing brushes 26. At the rear of the scrubber body 10 there is a squeegee 28 which has a vacuum nozzle 30 associated with it, with the vacuum nozzle 30 being connected by a conduit 32 to a recovery tank 34 which is a container for soiled cleaning solution. In this particular type of scrubber the cleaning solution is recycled. Thus, it is moved by a recycling pump 36 through a conduit 38 from the recovery tank 34 to the cleaning solution tank 20.

The vacuum recovery system includes a fan motor 40 adjacent to an exhaust blower 42 which has an air outlet 44. A demister tank 46 which removes as much fluid as possible from the air passing through the vacuum system is positioned in front of the exhaust blower 42 and houses a filter indicated at 48. The demister tank further includes a conduit 50 which connects the upper portion of the recovery tank 34 with the demister tank and positioned about this conduit, between the recovery tank and the demister tank 46 is a seal 52.

FIG. 3 discloses details of the assembly including the recovery tank, the demister tank and the seal 52. The demister tank 46 has a demister seal 54 which is adjacent a demister bracket 56 and a further demister bracket 58. The filter 48 is mounted within the demister tank 46 by means of a top plate 60 and a filter seal 62. On the opposite side of the demister tank 46 from conduit 50 there is a fan seal 64 and then the exhaust blower 42.

Focusing particularly on the seal 52, which is partially shown in cross section in FIG. 4, it may be described as having a generally U-shaped or possibly V-shaped cross section. It has two annular lips. As shown there is a larger outside diameter lip 66 and a smaller outside diameter lip 68, with the two lips being linked or joined together by a body portion 70. However, the two lips may be of equal diameter, depending on the configuration of the adjacent surfaces and the conduit being sealed. Also, the entire seal might be of some other shape than round, for example, square or oval, if the configuration of the adjacent parts to be sealed warranted some particular shape of seal. The seal will be positioned on the exterior of the conduit 50, with the inside of body 70 being sized to conform to the conduit exterior. The outside of the seal will be exposed to atmospheric pressure, indicated as 67 in FIG. 4, whereas the inside of the seal will be exposed to the vacuum of the air recovery system, indicated as 69 in FIG. 4, which will be at less than atmospheric pressure. This differential air pressure flexes the lips of the seal and presses them against the adjoining surfaces of the recovery tank, the demister tank and perhaps to some extent the conduit connecting these tanks. The greater the vacuum, the tighter the seal. There is more than adequate flexibility in the elastomeric material used in the seal to compensate for irregularities in the adjoining surfaces on which it bears, thus assuring a complete and tight seal to prevent atmospheric air from entering the vacuumized air system.

Whereas the preferred form of the invention has been shown and described herein, it should be realized that there may be many modifications, substitutions and alterations thereto.

The embodiments of the invention in which an exclusive property or privilege is claimed are defined as follows:

1. A surface maintenance machine including a body, wheels for supporting said body, a source of cleaning solution on said body, a first conduit for applying cleaning solution to a surface to be cleaned, scrub brushes carried by said body for scrubbing a surface to be cleaned, a squeegee carried by said body, a container for used cleaning solution on said body, a vacuum system including a vacuum fan assembly for removing used cleaning solution from adjacent the squeegee and conveying it to said container, said vacuum system including a second conduit between said container and said vacuum fan assembly, a seal extending about said second conduit and in contact with said container and vacuum fan assembly, with the exterior of said seal being exposed to atmospheric pressure and the interior of said seal being exposed to the less than atmospheric pressure of said vacuum system, said seal having connected annular lip portions, with the pressure difference between opposite sides of said seal moving said lip portions toward sealing contact with adjacent portions of said container and vacuum fan assembly.

2. The surface maintenance machine of claim 1 wherein said seal has a generally U-shaped cross section in a longitudinal direction, with one of said lips being positioned against said container.

3. The surface maintenance machine of claim 1 wherein one of said seal lips is larger than the other.

4. The surface maintenance machine of claim 3 wherein the larger of said seal lips is positioned against said container.

5. The surface maintenance machine of claim 3 wherein said vacuum fan assembly includes a demister tank, with one of said seal lips being positioned against said demister tank, and the other of said seal lips being positioned against said container, with the larger seal lip being positioned against said container and the smaller seal lip being positioned against said demister tank.

6. The surface maintenance machine of claim 5 wherein said seal includes a linking portion connecting said lips, with said linking portion being positioned against said second conduit.

* * * * *